US005265589A

United States Patent [19]

Wang

[11] Patent Number: 5,265,589

[45] Date of Patent: Nov. 30, 1993

[54] MULTIPLE-REHABILITATION-EQUIPMENT SUPPORTER

[76] Inventor: Yuen-Fu Wang, 3F., No. 29, Alley 6, Lane 125, Wuu Cherng Street, Taipei, Taiwan

[21] Appl. No.: 4,129

[22] Filed: Jan. 13, 1993

[51] Int. Cl.[5] ..... A61H 1/02

[52] U.S. Cl. ..... 128/25 R; 434/258; 482/62

[58] Field of Search ..... 128/25 R, 25 B; 482/57, 482/92, 121, 126, 133, 135, 138, 908, 62; 434/258, 260, 261; 297/174

[56] References Cited

U.S. PATENT DOCUMENTS 3,824,993 7/1974 Grant ..... 128/25 R
4,471,957 9/1984 Engalitcheff, Jr. ..... 434/260

*Primary Examiner*—Richard J. Apley
*Assistant Examiner*—Jeanne M. Mollo
*Attorney, Agent, or Firm*—Pro-Techtor International

[57] ABSTRACT

The present invention relates to a multiple-rehabilitation-equipment supporter which mainly consists of a table-like rack, a set of supporting framework, a set of arm pulling means, and a set of electrical pedals. With two square openings provided on top of the rack, and ring hangers and pin slots provided on the supporting framework, equipments for rehabilitation, such as manually-operated exerciser, throw trainer, push-pull spring exerciser, knuckle trainer, arm lifting trainer, circle-drawing exerciser, chest expander, etc., all can be simultaneously installed on the supporter according to the present invention. These equipments, together with the arm pulling exerciser and the electrical pedals incorporated in the supporter, provide users with multiple functions and the best benefits which are helpful to their rehabilitation.

2 Claims, 6 Drawing Sheets

MULTIPLE-REHABILITATION-EQUIPMENT SUPPORTER

BACKGROUND OF THE INVENTION

There are various kinds of rehabilitation equipments designed for apoplectics available in the market, such as manually-operated exerciser for turning movement of arms, pedals for turning movement of legs, push-pull spring exerciser for strengthening arm muscle and grip force, knuckle trainer for active up and down movement of fingers, arm lifting trainer for flexing elbows, chest expander for stretching and folding arms and thereby building chest muscle, etc. All of these equipments are generally separately fixed to a matching supporter and users must select and buy what they might need. It can be seen that perhaps three or four different supporters must be purchased if the same number of different equipments for rehabilitation are required for a user. It is obviously not economical nor convenient to have so many supporters which shall occupy a quite large space.

SUMMARY OF THE INVENTION

A multiple-rehabilitation-equipment supporter is therefore developed to eliminate the above-mentioned disadvantage existing in the currently separate rehabilitation equipment supporters. The supporter according to the present invention is basically designed with incorporated electrical pedals and arm pulling means while many other equipments, such as manually-operated exerciser, throw trainer, push-pull spring exerciser, knuckle trainer, arm lifting trainer, circle-drawing exerciser, chest expander, etc., all can be simultaneously installed thereon for the best utilization.

BRIEF DESCRIPTION OF THE DRAWINGS

The details of the present invention can be best understood through the following detailed description of the preferred embodiments and the accompanying drawings, wherein.

DETAILED DESCRIPTION OF THE PREFERRED EMBODIMENTS

Figure 1:
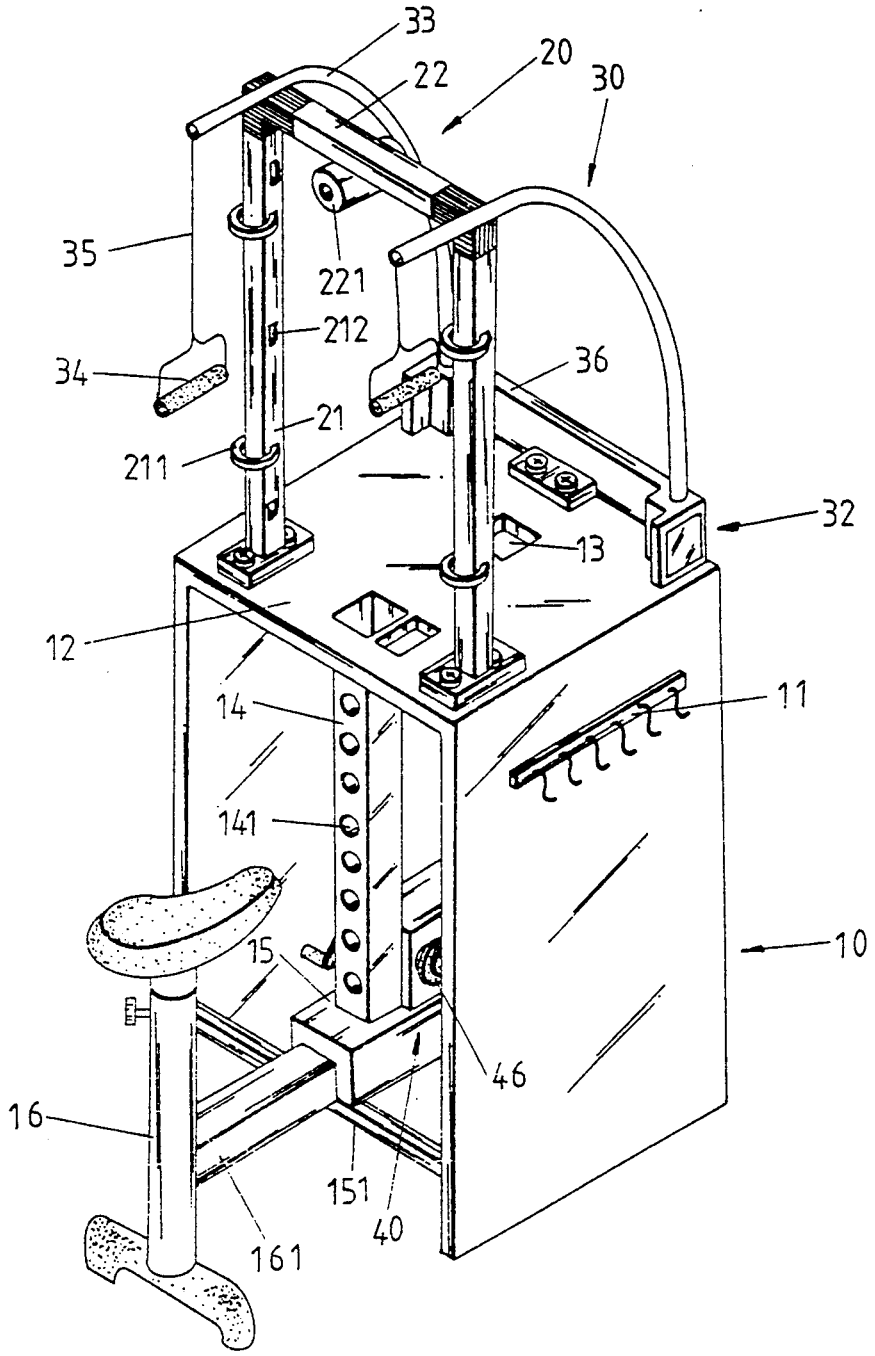
FIG. 1 is a three-dimensional perspective of the present invention.
Figure 2:
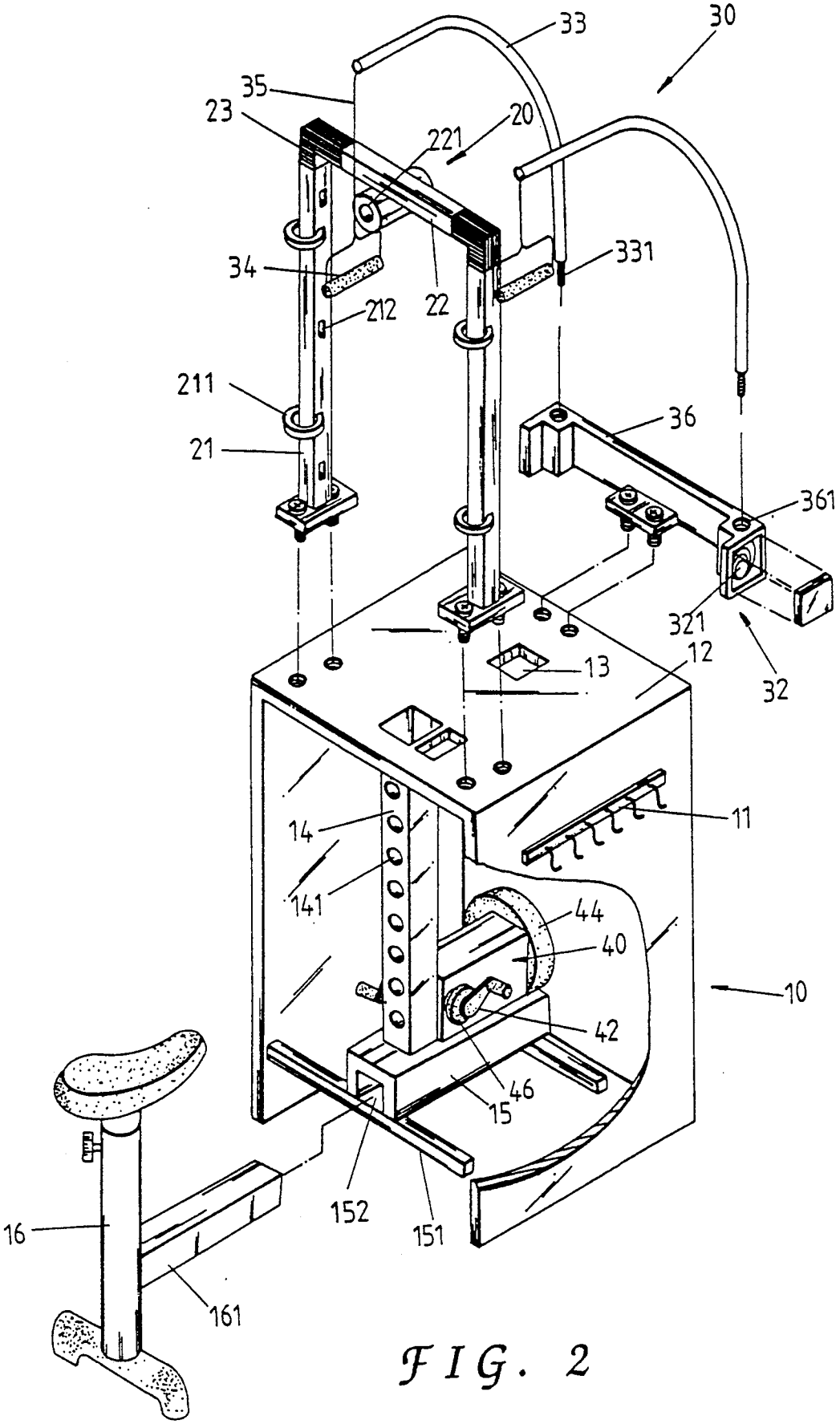
FIG. 2 is a partially exploded perspective of the present invention.

Please refer to FIGS. 1 and 2 for the preferred embodiment of the present invention which mainly consists of a table-like rack 10, a set of supporting framework 20, a set of arm pulling means 30, and a set of electrical pedals 40. The table-like rack 10 has hollow inside, a rack top 12, three continuous sidewalls with a front opening facing a user. A row of hangers 11 may be attached outside to one sidewall of the rack 10 for hanging other useful rehabilitation equipments. Two square openings 13 are longitudinally provided on the rack top 12 with the front square opening 13 downward extending to couple a hollow square column 14. Along the length of front face of the column 14, a plurality of small holes 141 are horizontally drilled; bottom end of the square column 14 is fixedly welded to a horizontally but longitudinally extended frame 15. A plurality of horizontally but transversely extended bars 151 are welded to bottom side of the frame 15 with their two ends fitly associate with two lateral side walls of the rack 10.

The frame 15 includes a forwardly open groove 152 which may fitly receive a bar 161 horizontally but longitudinally extending outward from a chair 16 so that the chair 16 may be stably located thereat. In addition to a height adjusting means, the chair 16 is further provided with a depth adjusting means which permits the bar 161 to move inward or outward in the groove 152 of the frame 15. With these means, the chair 16 is detachable from the rack 10, height-adjustable, and location-adjustable relative to the rack 10.

Figure 3:
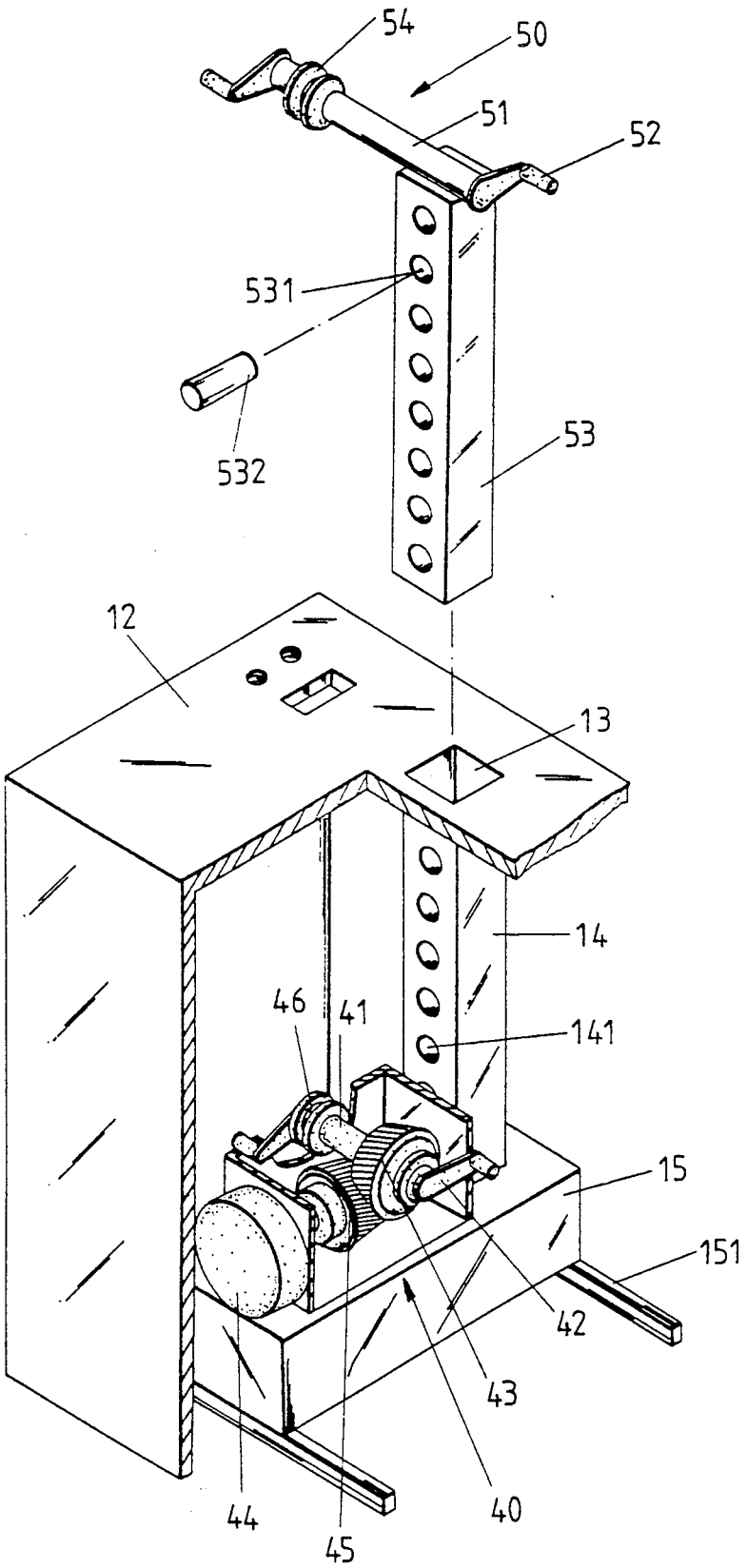
FIG. 3 shows an embodiment of the present invention on which a manually-operated exerciser is installed.
Figure 4:
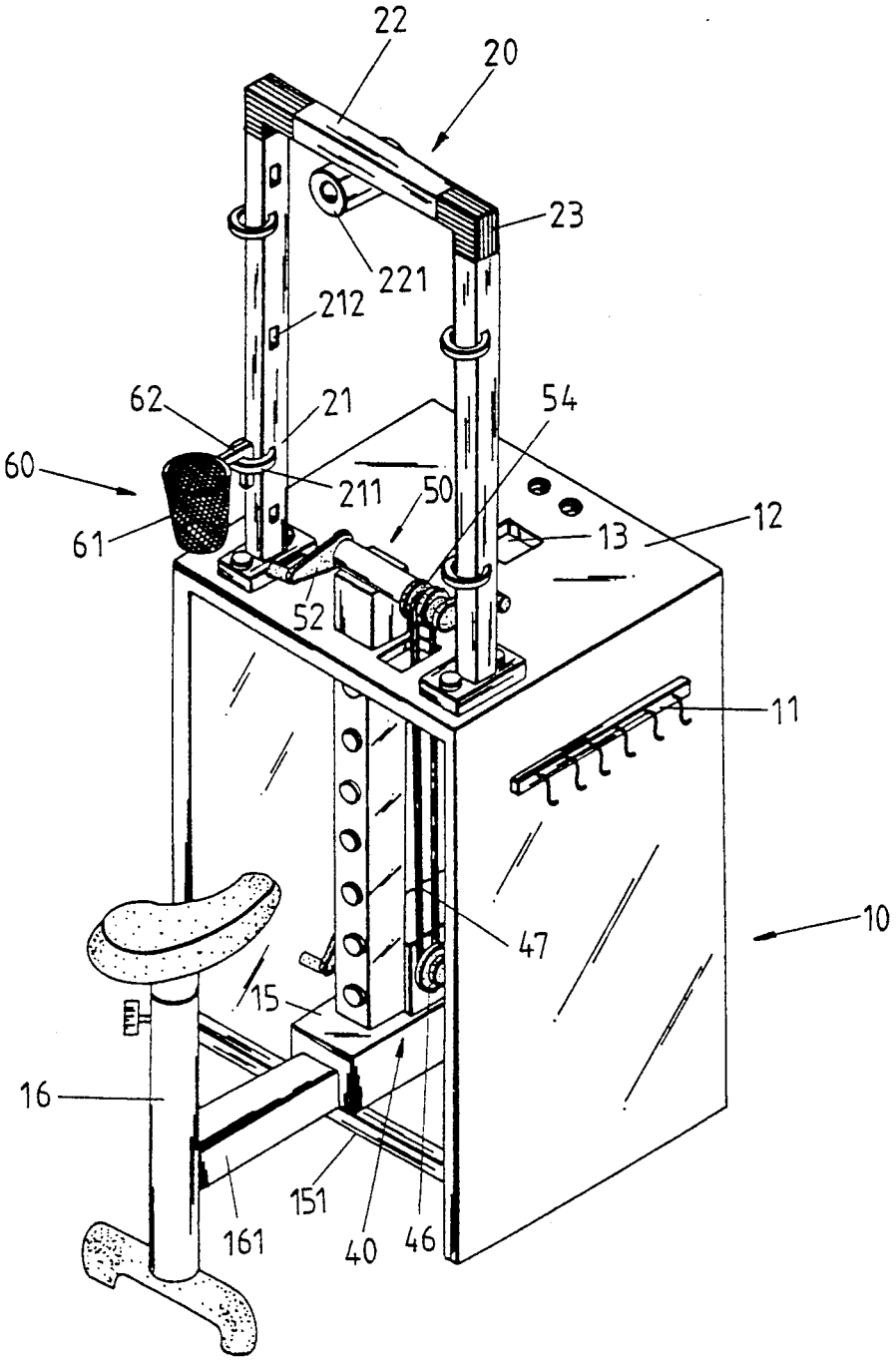
FIG. 4 shows another embodiment of the present invention on which an electrical pedal pair coupled with a manually-operated exerciser as well as a throw trainer are installed.

Please refer to FIGS. 2, 3, and 4, the set of electrical pedals 40 is installed on the frame 15 and includes a shaft 41, a pair of pedals 42 separately connected to each end of the shaft 41, a first bevel gear 43 disposed in the middle of the shaft 41, and a second bevel gear 45 driven by a motor 44 and capable of engaging with the first bevel gear 43. When the motor 44 starts, it shall drive the bevel gears 43, 45 which further cause the pair of pedals 42 to rotate relative to the shaft 41. The electrical pedals 42 shall be helpful to the rehabilitation of user's legs. A belt pulley 46 may be further provided on the shaft 41, allowing a belt 47 to be put thereon such that the belt 47 may be guided to another belt pulley 54 mounted on a manually-operated exerciser 50 optionally installed on the rack top 12, allowing the electrical pedals 42 and the manually-operated exerciser 50 to help the rehabilitation at the same time.

As shown in FIG. 2, the set of supporting framework 20 is mounted on two sides of the rack top 12 at proper position and consists of two vertically erected hollow square steel tubes 21 and a horizontal hollow square steel tube 22 two ends of which are separately connected to one of the vertical steel tubes 21 with unions 23 such that the entire set of supporting framework 20 is n-shaped. Ring hangers 211 are separately fixed to the front surfaces of the two vertical square steel tubes 21 at their upper and lower ¼ points; pin slots 212 are also formed and equally spaced on the two opposite inner surfaces of the two vertical steel tubes 21; and a fixing sleeve 221 is disposed in the middle of the horizontal square steel tube 22. In addition to flexible tubes 33 of the arm pulling means 30, many other equipments for rehabilitation can also be installed or mounted on the supporting framework 20.

The set of arm pulling means 30 consists of a rotary elastic force mechanism 32, two arched flexible tubes 33, two grips 34, and two pulling cords 35, and is installed at rear corners of the rack top 12, being supported by the supporting framework 20. The rotary elastic force mechanism 32 is the source of elastic force for the arm pulling means 30 and includes a housing 36 disposed near rear edge of the rack top 12, and helical springs 321 inside the housing 36. The housing 36 has two inner-threaded holes 361 on its top surface at each end thereof, allowing the hollow, arched, flexible, round tubes 33, with their outer-threaded bottom ends 331, to be separately and firmly screwed thereto. The pulling cords 35 pass through the hollow tubes 33 with their one end connected to the grips 34, and the other end to the helical springs 321, such that they shall provide enough elastic force when they are pulled.

According to the above-described assembly, the present invention has two fundamental functions, namely, electrical pedals 40 and arm pulling means 30, which may help the users with rehabilitation of their leg and arm joints by flexing the joints.

Following is a detailed explanation about the installation and usage of other available equipments of rehabilitation on the present invention:

1. Manually-operated exerciser 50, as shown in FIG. 3, includes a shaft 51 having two crank handles 52 separately connected to its two ends The shaft 51 is pivotly supported by a fixing column 53 such that the shaft 51 may freely rotate thereon. The fixing column 53 is designed to have a matching configuration with the hollow square column 14 so that it may be inserted into the column 14 through the front square opening 13 on the rack top 12. By means of aligning the small holes 141 on the column 14 with those corresponding small holes 531 on the column 53 and locking them with pins 532, the manually-operated exerciser 50 is assembled. The user may exert himself or herself to rotate the crank handles 52 to achieve the goal of rehabilitation. Since the exerciser 50 has not any driving power, and in consideration of some users who are more serious patients without the ability to rotate the crank handles 52 by themselves, the belt 47, as shown in FIG. 4, of the belt pulley 46 of the electrical pedals 40 may be guided and pulled up to the belt pulley 54 provided on the shaft 51 of the exerciser 50 above the rack top 12. When the motor 44 starts, it would drive the pedals 40 and the manually-operated exerciser 50 at the same time to help the more serious patients to do their rehabilitation easier.

2. Throw trainer 60, as shown in FIG. 4, includes a circular frame 61 similar to a basket ring, having a hook 62 provided at one side for hooking the frame 61 onto one of the ring hangers 211 on the n-shaped supporting framework 20. When the user bends or crouches to pick up cloth-wrapped bundles and throw the same toward the circular frame 61, his or her waist, spine, leg joints, and wrists all have chances to move.

Figure 5:
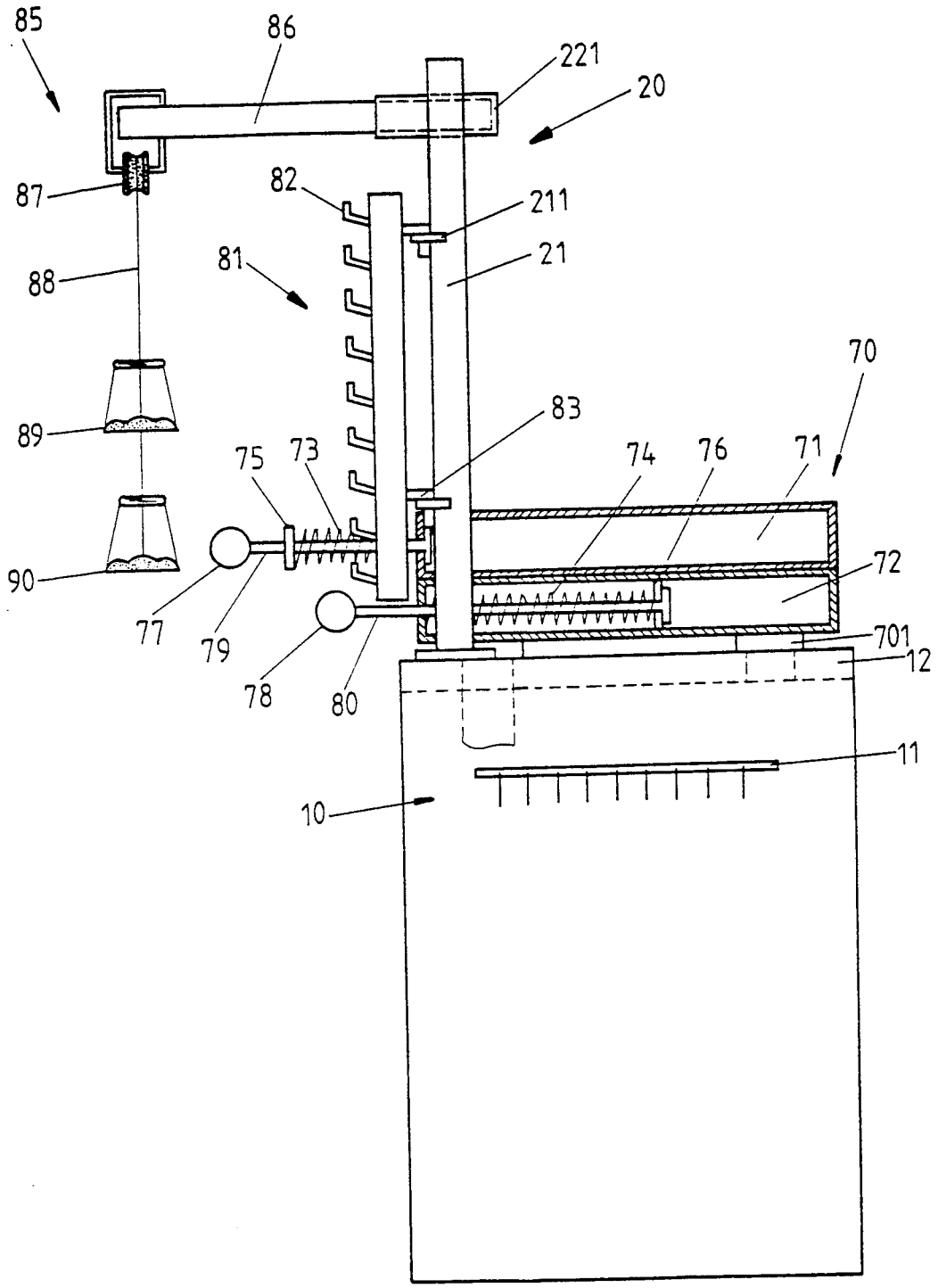
FIG. 5 shows another embodiment of the present invention on which a push-pull spring exerciser, a knuckle trainer, and an arm lifting trainer are installed.

3. Push-pull spring exerciser 70, as shown in FIG. 5, includes two vertically superposed cylindrical housings 71, 72, springs 73, 74, stoppers 75, 76, knobs 77, 78, and stems 79, 80 which movably extend into the housings 71, 72, respectively The stopper 75 locates in front of the stem 79, allowing the spring 73 to be put over the stem 79 outside the cylindrical housing 71 between the stopper 75 and the front wall of the cylindrical housing 71; the stopper 76 locates at the rear end of the stem 80, allowing the spring 74 to be put over the stem 80 inside the cylindrical housing 72 between the stopper 76 and the front wall of the cylindrical housing 72. The entire push-pull spring exerciser 70 can be firmly mounted on the rack top 12 by inserting its two fixing legs 701 down into the two square openings 13. To use the exerciser 70, hold the knobs 77, 78 respectively connected to front ends of the stems 79, 80, then push the knob 77 and pull the knob 78 at the same time, and the springs 73, 74 shall produce sufficient resistance, allowing the user to strengthen his or her arm muscle and grip.

4. Knuckle trainer 81, as shown in FIG. 5, includes a ladder-like means having a line of vertically arranged and aligned hanger-like members 82 thereon, and being suitable for hooking onto the ring hangers 211 of the n-shaped supporting framework 20 by means of an upper and a lower hooks 83 provided on its back The user may put his or her fingers on the hanger-like members 82 and move the same up and down along the line of hanger-like members 82 so as to train his or her fingers and arms to move more actively.

5. Arm lifting trainer 85, as shown in FIG. 5, includes an extended bar 86 coupled with the horizontal steel tube 22 of the n-shaped supporting framework 20 at its rear end by engaging it with the fixing sleeve 221. The extended bar 86 has a pulley 87 provided at its front end. A connection cord 88 is put through the pulley 87 with its two ends separately connecting a grip means 89, 90. The user may sit on the chair 16, lifts up his or her arms and holds the two grip means 89, 90 while alternately pulls down the grip means 89, 90 so as to move his or her shoulder and elbow joints.

Figure 6:
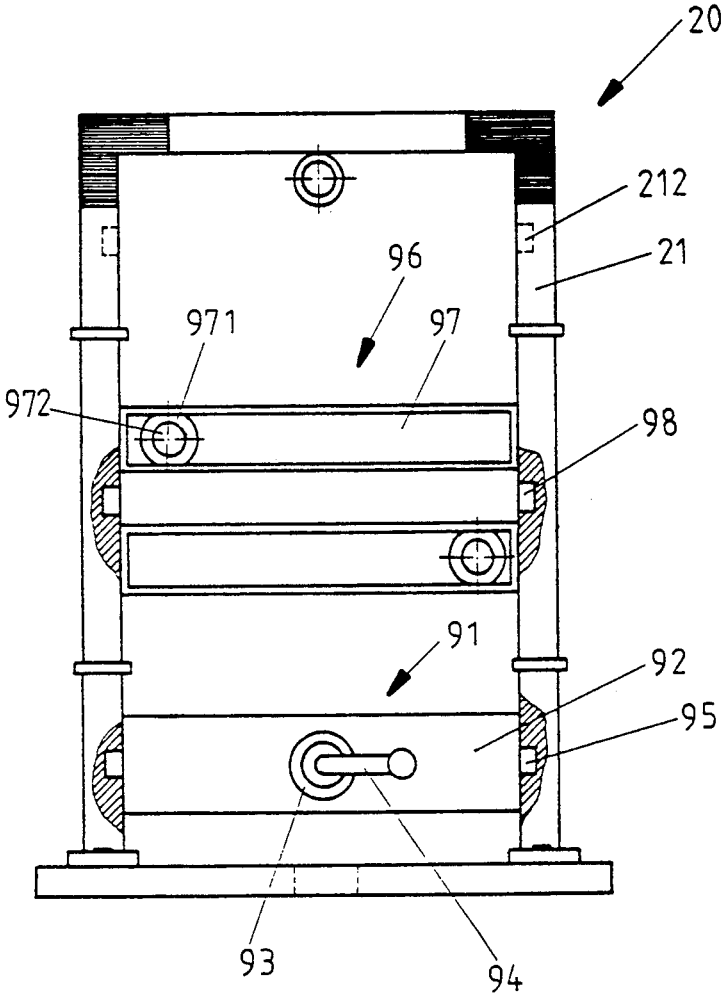
FIG. 6 shows still another embodiment of the present invention on which a circle-drawing exerciser and a chest expander are installed.

6. Circle-drawing exerciser 91, as shown in FIG. 6, includes a rectangular steel tube 92 the center of its front surface is provided with a bearing 93, and a crank lever 94 circumferentially rotatably installed in a central hole of the bearing 93. The circle-drawing exerciser 91 is fixed to the vertical steel tubes 21 of the n-shaped supporting framework 20 by inserting two lugs 95 at two lateral sides of the exerciser 91 into the pin slots 212 formed on the vertical steel tubes 21. The user may grip the crank lever 94 and rotate the same circumferentially so as to move his or her elbow joints.

7. Chest expander 96, as shown in FIG. 6, includes an upper and a lower rectangular box-like recesses 97, two pulleys 971 separately installed in the recesses 97, and two woodcovered bar-like round handles 972 separately connected to the center of pulleys 971. The chest expander 96 is fixed to the n-shaped supporting framework 20 by inserting lugs 98 provided at two lateral sides thereof into the pin slots 212 formed on the vertical steel tubes 21. With the pulleys 971 sliding within the rectangular recesses 97, the user may stretch or fold his or her arms alternately and thereby expands the chest.

What is claimed is:

1. A multiple-rehabilitation-equipment supporter comprising a table-like rack, a set of supporting framework, a set of arm pulling means, and a set of electrically driven pedals;

said table-like rack having a rack top and three continuous sidewalls with a front opening to enclose a hollow space facing a user, a row of hangers attached outside to one of said sidewalls of said rack adapted for hanging other useful rehabilitation equipments, two square openings longitudinally provided on said rack top with the front one downward extending to couple a hollow square column; said hollow square column having a plurality of vertically arranged but horizontally drilled small holes along its front face and being fixedly welded to a horizontally but longitudinally extended frame at its bottom end; said extended frame again being welded to a plurality of horizontally but transversely extended bars such that said extended bars fitly associate with two lateral side walls of said rack at their two ends; said extended frame also including a forwardly open groove which may fitly receive a bar horizontally but longitudinally extending outward from a chair so that the chair may be stably located thereat;

said set of supporting framework being mounted on said rack top at proper position and consisting of two vertically erected hollow square steel tubes and a horizontal hollow square steel tube which together form an n-shaped configuration; said vertical hollow square steel tubes having a plurality of ring hangers separately fixed to their front surfaces and a plurality of pin slots formed and equally spaced on their opposite inner surfaces; and said horizontal hollow square steel tube having a fixing sleeve disposed in the middle portion thereof; said set of arm pulling means consisting of a rotary elastic force mechanism, two hollow arched, flexible round tubes, two grips, and two pulling cords; said elastic force mechanism being the source of elastic force for said arm pulling means and including a housing fixed to said rack top near rear edge thereof, and helical springs provided inside said housing; said housing further having two inner-threaded holes on its top surface at each end thereof, allowing said hollow, arched, flexible, round tubes, with their outer-threaded bottom ends, to be separately and firmly screwed thereto; and said pulling cords passing through said hollow tubes with their one end connected to said grips and the other end to said helical springs such that they shall provide enough elastic force when they are pulled; and said set of electrically driven pedals being installed on said frame welded to bottom end of said hollow square column and including a shaft, a pair of pedals separately connected to each end of said shaft, a first bevel gear disposed in the middle portion of said shaft, and a second bevel gear driven by a motor and capable of engaging with said first bevel gear; said shaft having a belt pulley adapted to receive a belt to be put thereon such that the belt may be guided to another belt pulley mounted on a manually-operated exerciser optionally installed on said rack top so that said electrically driven pedals and said optional manually-operated exerciser may be driven to move at the same time.

2. A multiple-rehabilitation-equipment supporter as claimed 1, wherein said supporter may further have a manually-operated exerciser installed thereon; said manually-operated exerciser including a shaft having two crank handles separately connected to its two ends and being pivotly supported by a fixing column such that said shaft may freely rotate thereon; said fixing column being able to be inserted into said hollow square column through said front square opening on said rack top and fixed in place by aligning small holes on said hollow square column with corresponding small holes provided on said fixing column and inserting pins into the aligned holes; and said shaft having a belt pulley provided thereon which allows said manually-operated exerciser to rotate together with said electrically driven pedals when a belt is put thereon to couple it and said belt pulley mounted on said electrically driven pedals and said motor is started up.

* * * * *